US010138032B2

(12) United States Patent
Chang

(10) Patent No.: US 10,138,032 B2
(45) Date of Patent: Nov. 27, 2018

(54) FASTENER ASSEMBLY

(71) Applicant: Chi-Hsiung Chang, Taichung (TW)

(72) Inventor: Chi-Hsiung Chang, Taichung (TW)

( * ) Notice: Subject to any disclaimer, the term of this patent is extended or adjusted under 35 U.S.C. 154(b) by 442 days.

(21) Appl. No.: 14/936,621

(22) Filed: Nov. 9, 2015

(65) Prior Publication Data

US 2017/0129645 A1 May 11, 2017

(51) Int. Cl.

*B65H 49/00* (2006.01)
*B65D 43/22* (2006.01)
*B65D 21/02* (2006.01)

(52) U.S. Cl.

CPC ..... *B65D 43/22* (2013.01); *B65D 21/0209* (2013.01)

(58) Field of Classification Search

CPC B65D 43/22; B65D 21/0209; B65D 21/0217; B65D 21/0224; B65D 21/0204; B65D 21/023; B65D 45/20; B65D 2251/1058; A45C 13/1084

USPC ..... 220/23.83, 4.01, 4.21, 4.22, 4.26, 4.27, 220/23.6, 810; 206/503, 504, 508, 509; 292/113, 247

See application file for complete search history.

(56) References Cited

U.S. PATENT DOCUMENTS 8,573,715 B1 * 11/2013 Jackman ..... A47K 10/32 220/4.22

* cited by examiner

*Primary Examiner* — J. Gregory Pickett
*Assistant Examiner* — Elizabeth Volz
(74) *Attorney, Agent, or Firm* — Bruce Stone LLP; Joseph Bruce

(57) ABSTRACT

A fastener assembly disposed at a lateral edge of a container includes: a first fixing member, two second fixing members, and a retaining member. The second fixing members each includes a fixing seat which includes a pivot recess and a restricting recess, and a pivot ear which includes a pivot end and an engaging recess, and the pivot ends are pivoted in the pivot recesses. The retaining member includes two restricting ribs and two push ribs, the restricting ribs are restricted in the restricting recesses of the fixing seats, and the push ribs are pushed against the two pivot ears, so as to prevent the pivot ears from pivoting outward. In addition to being used as a lock on a single container to lock the upper and lower covers, the fastener assembly can also be used to assemble a plurality of containers together in desired patterns.

3 Claims, 10 Drawing Sheets

FASTENER ASSEMBLY

BACKGROUND OF THE INVENTION

Field of the Invention

The present invention relates to a fastener assembly, and more particularly to a fastener assembly which can be used on a single container to lock the container or can be used to assemble two or more containers together.

Related Prior Art

A container is normally provided with an upper cover and a lower cover which are pivoted to each other. The container is provided with an inner space for storage of objects. However, the inner space is limited, therefore, a user has to use many containers to carry more objects or tools. Currently, there is no way to assemble many containers together, therefore, the transportation of so many containers will be inconvenient.

The present invention has arisen to mitigate and/or obviate the afore-described disadvantages.

SUMMARY

One objective of the present invention is to provide a fastener assembly disposed at a lateral edge of a container, which allows a plurality of containers to be assembled together or disassembled from one another.

Another objective of the present invention is to provide a fastener assembly which is used as a lock on a single container to lock upper and lower covers of the container together.

To achieve the above objectives, a fastener assembly is disposed at a lateral edge of a container and comprises: a first fixing member disposed at the lateral edge of the container, and comprising two engaging ends; two second fixing members disposed at the lateral edge of the container, and each comprising a fixing seat and a pivot ear, each of the fixing seats including a pivot recess and a restricting recess, each of the pivot ears including a pivot end and an engaging recess, each of the pivot ends being pivoted in the pivot recess of a corresponding one of the fixing seats; and a retaining member disposed at the lateral edge of the container and provided with two restricting ribs on an inner surface thereof, and two push ribs at two ends thereof, the restricting ribs of the retaining member being restricted in the restricting recesses of the fixing seats, and the push ribs being pushed against the two pivot ears, so as to prevent the pivot ears from pivoting outward.

Preferably, the container comprises an upper cover and a lower cover, the first fixing member is disposed at a lateral edge of the upper cover, and the second fixing members are disposed at a lateral edge of the lower cover.

Preferably, the container comprises an upper cover and a lower cover, the second fixing members are disposed at a lateral edge of the upper cover, and the first fixing member is disposed at a lateral edge of the lower cover.

Preferably, a receiving recess is formed at the lateral edge of the container, and each of the upper and lower covers is provided with a receiving space which is located in the receiving recess.

DETAILED DESCRIPTION

The present invention will be clearer from the following description when viewed together with the accompanying drawings, which show, for purpose of illustrations only, the preferred embodiment in accordance with the present invention.

Figure 1:
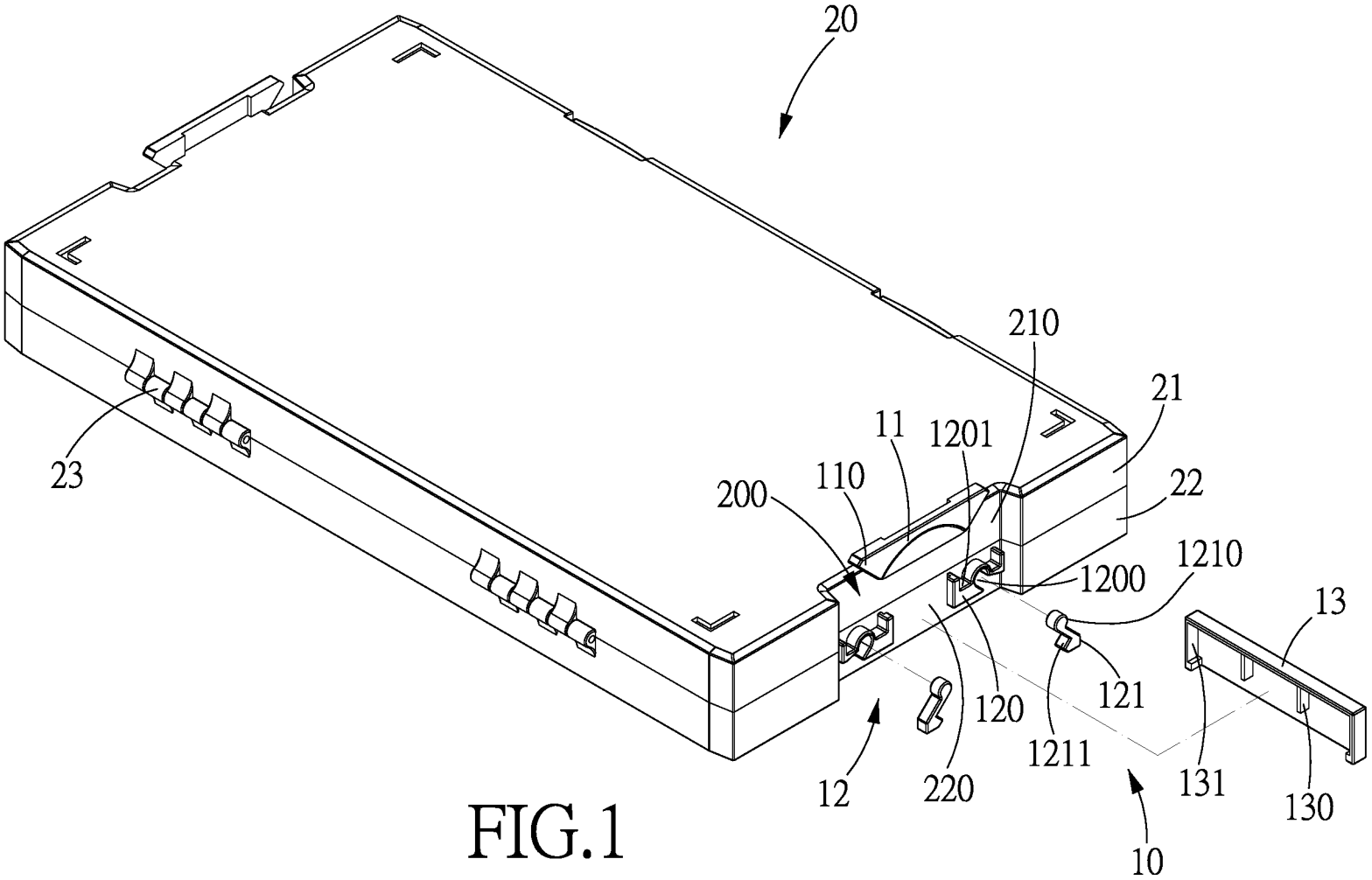
FIG. 1 is an illustrative view showing that the fastener assembly in accordance with the preferred embodiment of the present invention is used on a single container.
Figure 2:
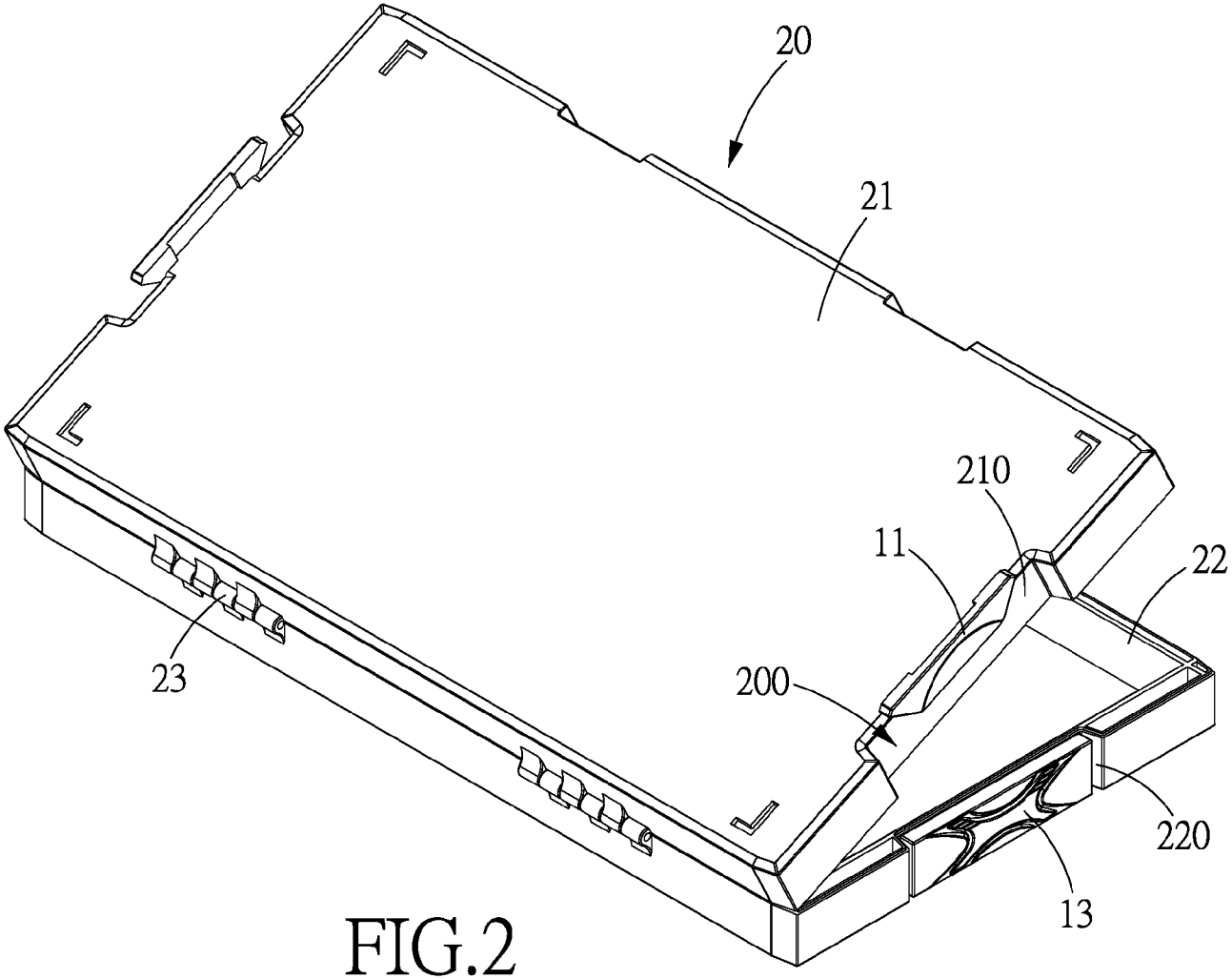
FIG. 2 is another illustrative view showing that the fastener assembly in accordance with the preferred embodiment of the present invention is used on a single container.
Figure 9:
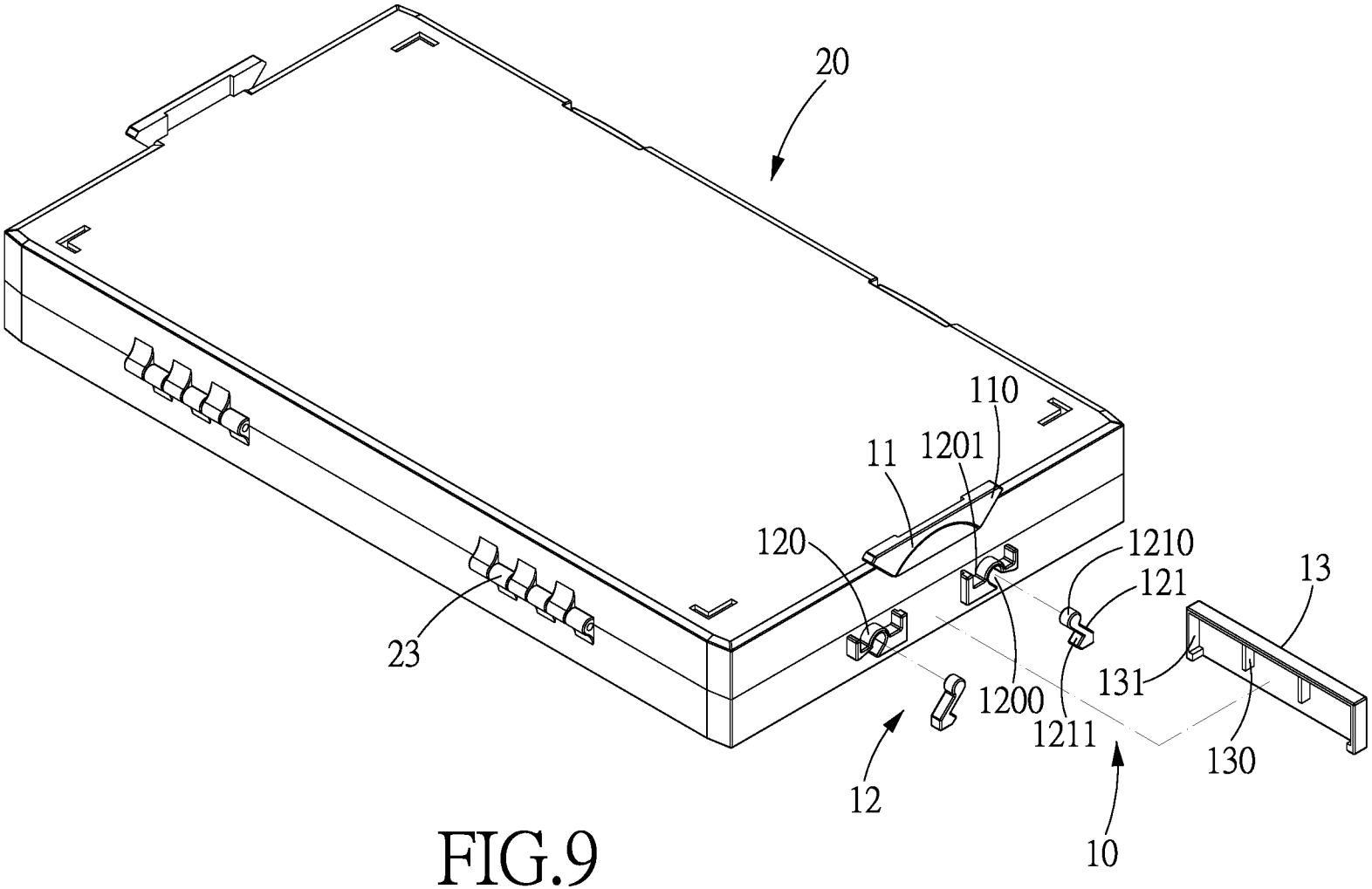
FIG. 9 is another illustrative view showing that the fastener assembly in accordance with the preferred embodiment of the present invention is used on a single container.

Referring to FIGS. 1, 2 and 9, a fastener assembly 10 in accordance with a preferred embodiment of the present invention comprises: a first fixing member 11, at least two second fixing members 12 and a retaining member 13.

The first fixing member 11 is selectively disposed on a lateral edge or in a receiving recess 200 at the lateral edge of a container 20, and includes two engaging ends 110 which protrude out of a top surface of the container 20.

Each of the second fixing members 12 is selectively disposed on the lateral edge or in the receiving recess 200 at the lateral edge of a container 20, and includes a fixing seat 120 and a pivot ear 121. Each of the fixing seats 120 includes a pivot recess 1200 and a restricting recess 1201. Each of the pivot ears 121 includes a pivot end 1210 and an engaging recess 1211. Each of the pivot ends 1210 is pivoted in the pivot recess 1200 of a corresponding one of the fixing seats 120.

The retaining member 13 is provided with two restricting ribs 130 on an inner surface thereof and two push ribs 131 at two ends thereof.

Each of the pivot ends 1210 is pivoted in the pivot recess 1200 of a corresponding one of the fixing seats 120, so that the pivot ear 121 are able to pivot left and right with respect to the fixing seats 120. Each of The restricting ribs 130 of the retaining member 13 is restricted in the restricting recess 1201 of a corresponding of the fixing seats 120, and the push ribs 131 are abutted against the two pivot ears 121, so as to form the fastener assembly 10.

Figure 3:
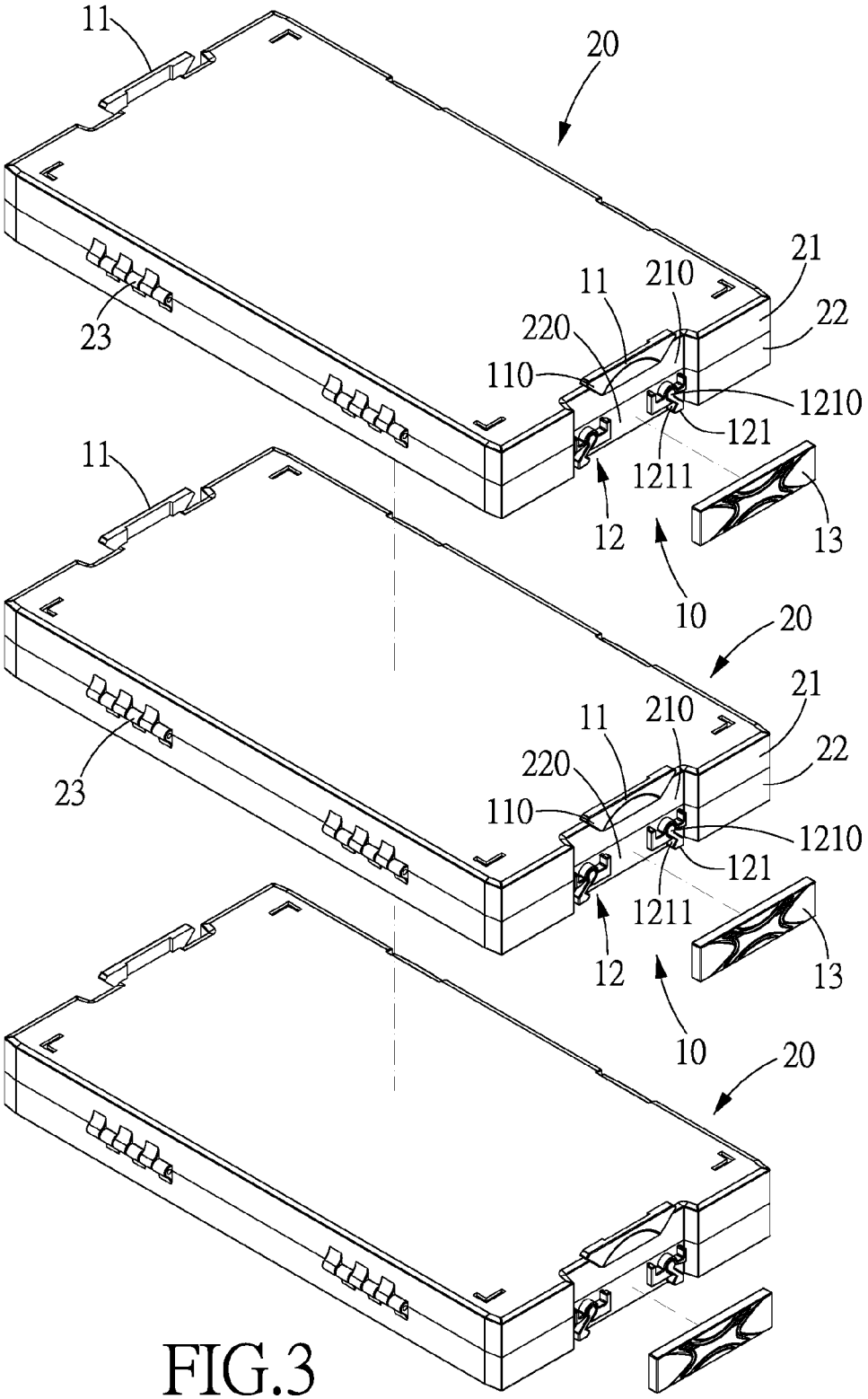
FIG. 3 is an illustrative view showing that the fastener assembly in accordance with the preferred embodiment of the present invention is used to assemble a plurality of containers in a stacked manner.
Figure 4:
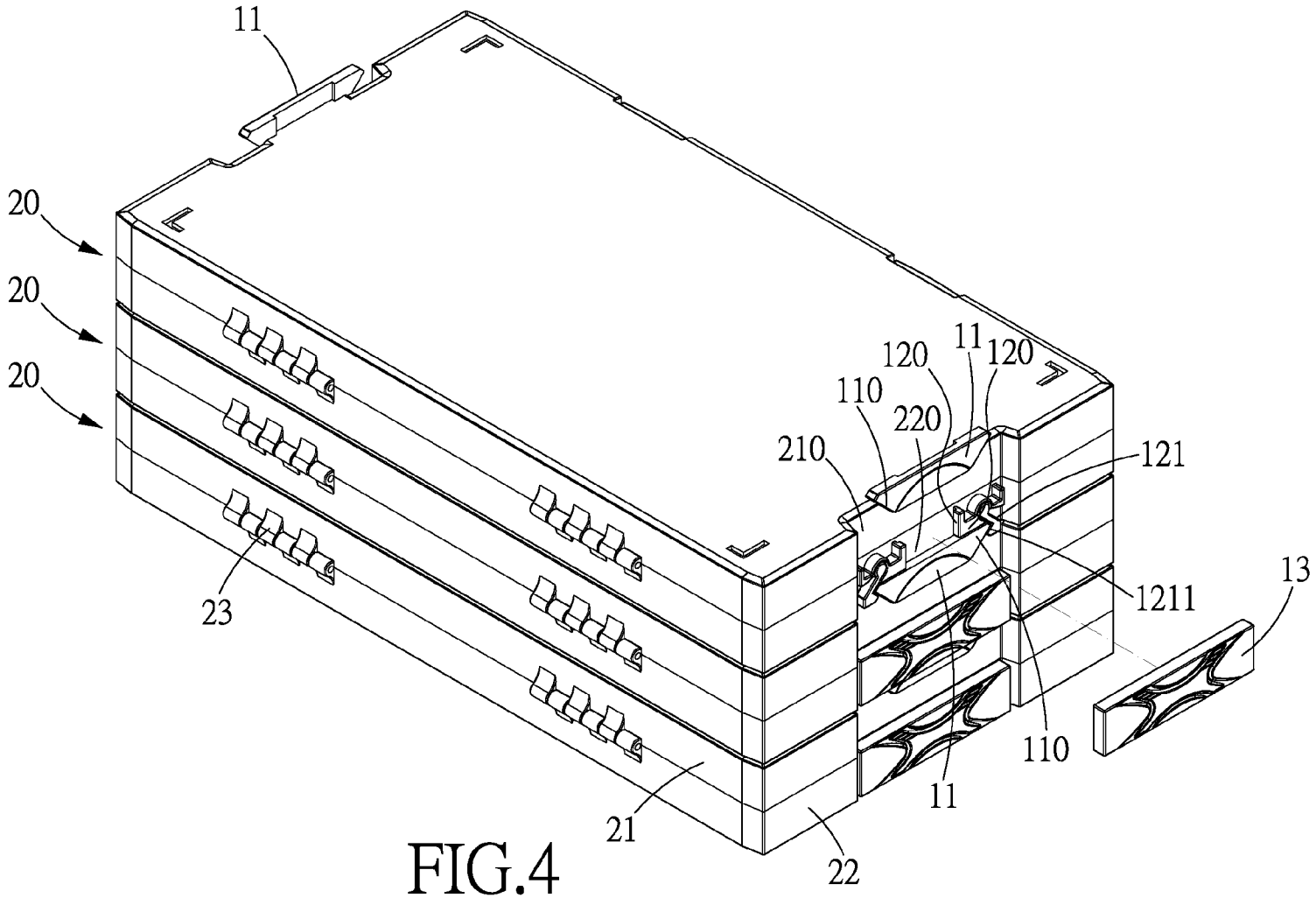
FIG. 4 is another illustrative view showing that the fastener assembly in accordance with the preferred embodiment of the present invention is used to assemble a plurality of containers in a stacked manner.

Referring then to FIGS. 3 and 4, the container 20 includes an upper cover 21 and a lower cover 22 which are pivoted to each other by a pivot portion 23, and therefore can be closed or opened relative to each other. Each of the upper and lower covers 21, 22 includes a receiving space 210, 220 combined together to form the receiving recess 200.

The first fixing member 11 of the fastener assembly 10 is disposed in the receiving space 210 of the upper cover 21, and the second fixing member 12 is disposed in the receiving space 220 of the lower cover 22. To assemble two containers 20 together, the lower cover 22 of one container 20 can be mounted on the upper cover 21 of another container 20, the pivot ears 121 of the second fixing member 12 will be pushed by the first fixing member 11 to slightly pivot outward, which allows the engaging ends 110 of the first fixing member 11 of the upper cover 21 to be engaged in the engaging recesses 1211 of the pivot ears 121 of the second fixing member 12. Then, the retaining member 13 has the restricting rib 130 restricted in the restricting recess 1201 of the fixing seat 120, and has the two push ribs 131 abutted against the pivot ears 121 to prevent the pivot ears 121 from further pivoting outward, so that the second fixing member 12 of the lower cover 22 of one container 20 is engaged with the first fixing member 11 of the upper cover 21 of another container 20, and in this way, two or more containers 20 can be assembled one on top of the other.

The disassembling of the two containers 20 from each other only requires the removal of the retaining member 13, when the retaining member 13 is removed, the restricting ribs 130 of the retaining member 13 are disengaged from the restricting recesses 1201 of the fixing seats 120, the pivot ears 121 are not stopped by the push ribs 131 anymore and therefore are able to pivot outward to allow the engaging ends 110 of the first fixing member 11 to be disengaged from the engaging recesses 1211 of the pivot ears 121, and thus the two containers 20 (or more containers) can be disassembled from each other.

Figure 5:
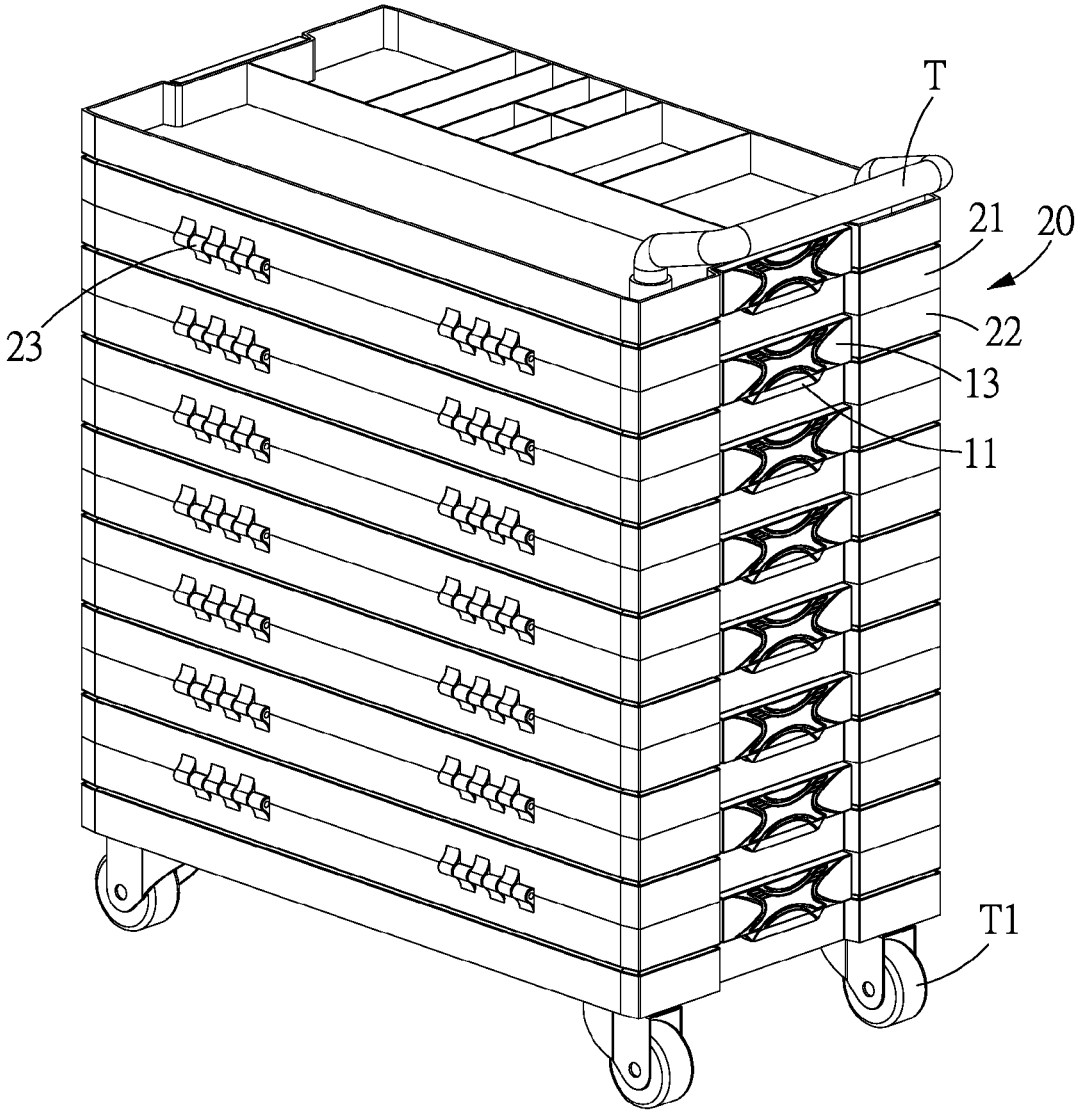
FIG. 5 is yet another illustrative view showing that the fastener assembly in accordance with the preferred embodiment of the present invention is used to assemble a plurality of containers in a stacked manner.

Referring then to FIG. 5, a plurality of containers 20 are assembled on top of one another by the retaining assemblies 10, the topmost container 20 is provided with a handle T and the lowermost container 20 is provided with wheels T1 for easy transportation of the plurality of containers 20, unlike the conventional containers 20 which cannot be assembled together, so that the conventional containers 20 have to be moved manually one by one.

Figure 6:
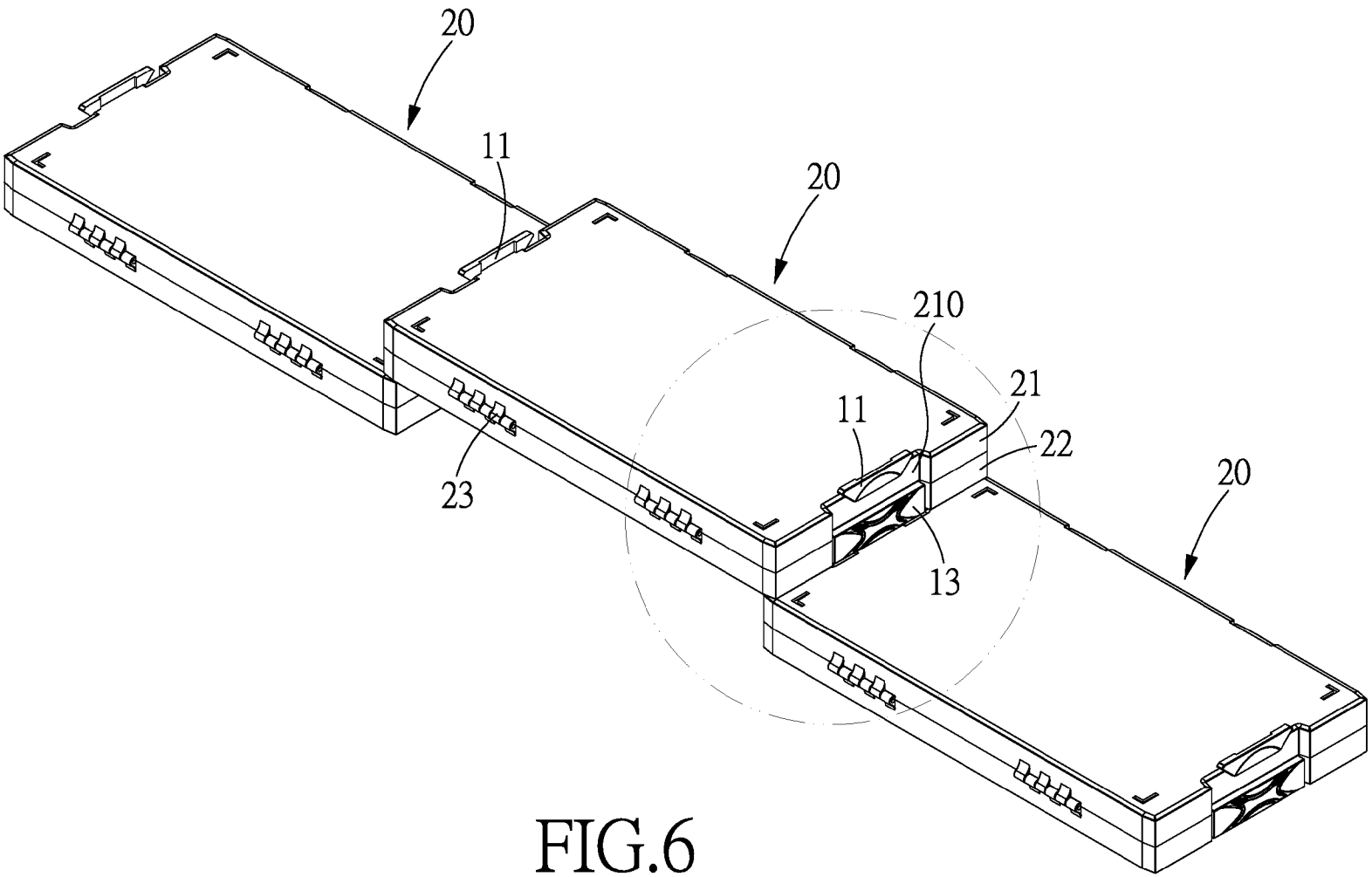
FIG. 6 is an illustrative view showing that the fastener assembly in accordance with the preferred embodiment of the present invention is used to assemble a plurality of containers in a side-by-side manner.
Figure 7:
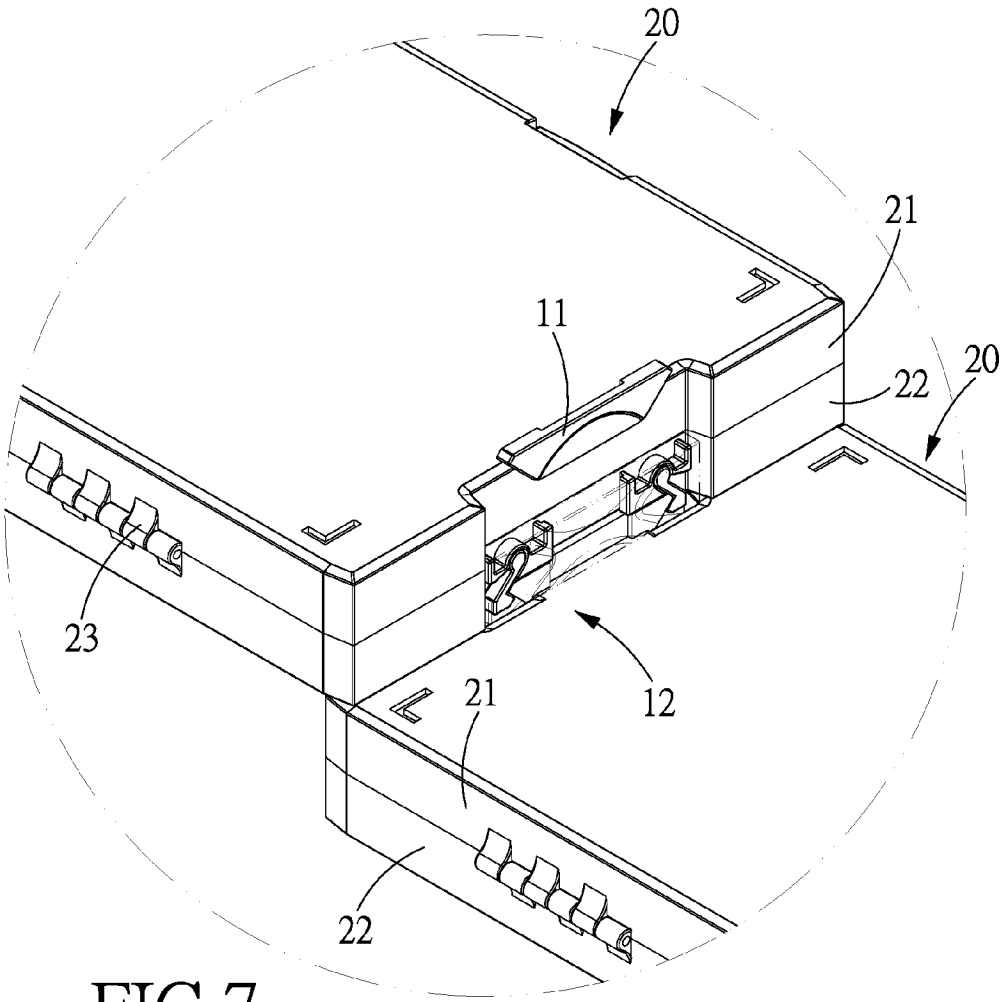
FIG. 7 is a magnified view of a part of FIG. 6.

Referring then to FIGS. 6 and 7, with the fastener assembly 10, the containers 20 can not only be assembled one on top of the other, but also side by side (more specifically, one container bridged over another two containers). Since this assembly is the same as abovementioned, further descriptions would seem unnecessary.

Figure 8:
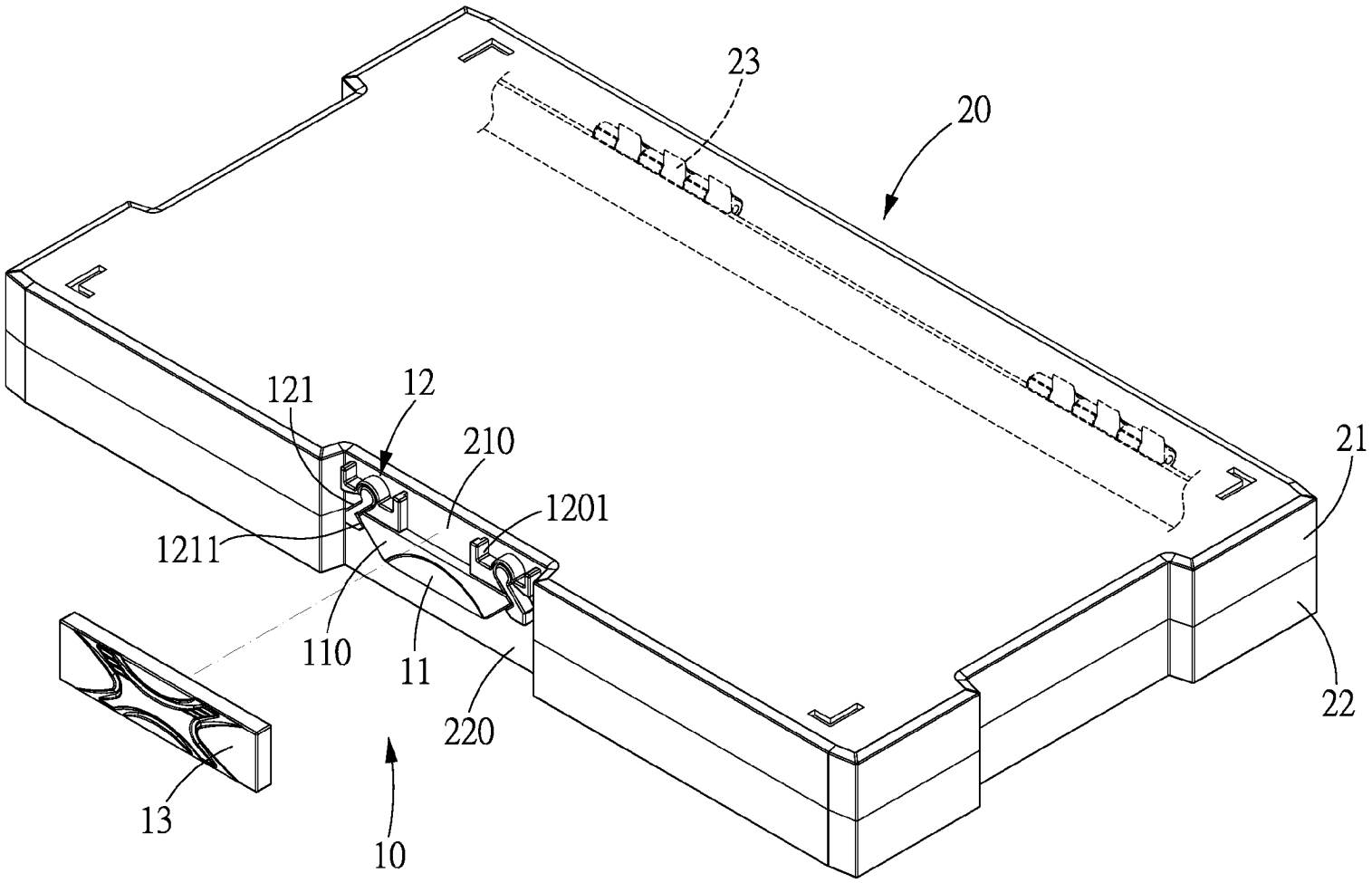
FIG. 8 is another illustrative view showing that the fastener assembly in accordance with the preferred embodiment of the present invention is used on a single container.
Figure 10:
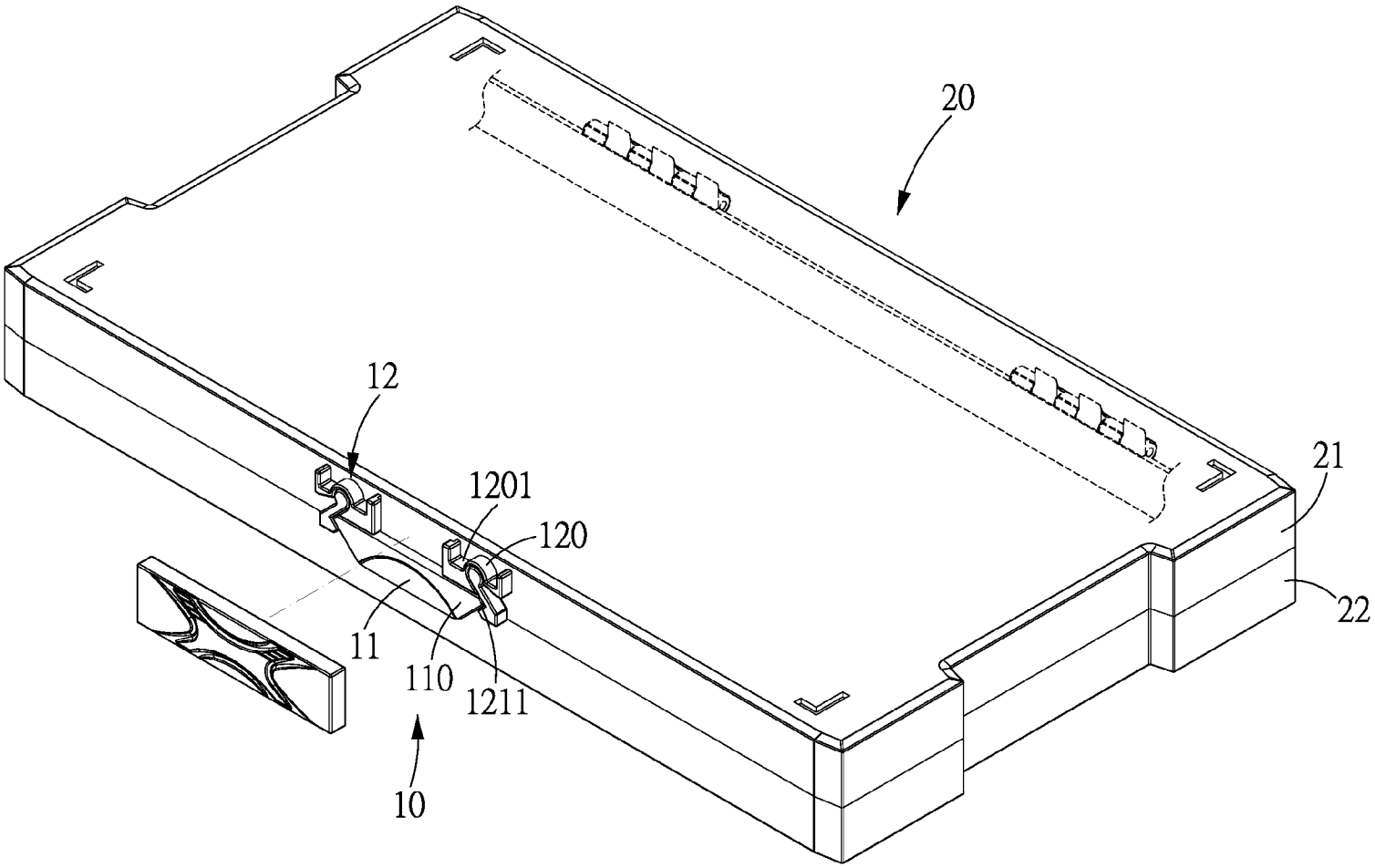
FIG. 10 is another illustrative view showing that the fastener assembly in accordance with the preferred embodiment of the present invention is used on a single container.

Referring then to FIGS. 8 and 10, which show another preferred embodiment of the present invention, where the fastener assembly 10 is used on a single container 20. In this embodiment, the fastener assembly 10 can also be selectively disposed in the receiving recess 200 on the lateral edge of the container 20 or directly on the lateral edge of the container 20. More specifically, the first fixing member 11 can be disposed on the lateral edge of the lower cover 22 or in the receiving space 220 on the lateral edge of the lower cover 22, and the second fixing member 12 can be disposed on the lateral edge of the upper cover 21 or in the receiving space 210 of the lateral edge of the upper cover 21. Firstly, the engaging ends 110 of the first fixing member 11 are engaged in the engaging recesses 1211 of the pivot ears 121 of the second fixing member 12. Then, the restricting ribs 130 of the retaining member 13 are restricted in the restricting recesses 1201 of the fixing seats 120, and the two push ribs 131 are pushed against the pivot ears 121 to prevent the pivot ears 121 from further pivoting outward, so that the first fixing member 11 of the lower cover 22 of the container 20 is engaged with the second fixing member 12 of the upper cover 21, to lock the upper cover 21 to the lower cover 22.

Therefore, in addition to being used as a lock on a single container 20 to lock the upper and lower covers 21, 22, the fastener assembly 10 of the present invention can also be used to assemble a plurality of containers 20 together in desired patterns.

It is to be noted that no matter how and where the fastener assembly 10 is used, as a lock on a single container 20 or to assemble a plurality of containers 20 together, the fastener assembly 10 can be selectively disposed on the lateral edge of the container 20 or in the receiving spaces 210, 220 at the lateral edge of the upper and lower covers 21, 22 of the container 20.

While we have shown and described various embodiments in accordance with the present invention, it is clear to those skilled in the art that further embodiments may be made without departing from the scope of the present invention.

What is claimed is:

1. A fastener assembly being disposed at a lateral edge of a container, comprising:

a first fixing member disposed at the lateral edge of the container, and comprising two engaging ends;

two second fixing members disposed at the lateral edge of the container, and each comprising a fixing seat and a pivot ear, each of the fixing seats including a pivot recess and a restricting recess, each of the pivot ears including a pivot end and an engaging recess, the pivot ends of the pivot ears being pivoted in the pivot recesses of the fixing seats, respectively; and a retaining member disposed at the lateral edge of the container, wherein the retaining member is provided with two restricting ribs on an inner surface thereof, and two push ribs at two ends thereof, the restricting ribs of the retaining member are restricted in the restricting recesses of the fixing seats, respectively, and the push ribs are abutted against the two pivot ears, so as to prevent the pivot ears from pivoting outward;

the container comprises an upper cover and a lower cover which are pivoted to each other by a pivot portion and capable of being closed and opened relative to each other, a receiving recess is formed at the lateral edge of the container, each of the upper and lower covers is provided with a receiving space, and the receiving spaces of the upper and lower covers are combined to form the receiving recess.

2. The fastener assembly as claimed in claim 1, wherein the first fixing member is disposed in the receiving space of the upper cover, and the second fixing members are disposed in the receiving space of the lower cover.

3. The fastener assembly as claimed in claim 1, wherein the second fixing member is disposed in the receiving space of the upper cover, and the first fixing member is disposed in the receiving space of the lower cover.

* * * * *